US010001286B2

(12) United States Patent
Jeon

(10) Patent No.: US 10,001,286 B2
(45) Date of Patent: Jun. 19, 2018

(54) DEHUMIDIFIER

(71) Applicant: LG ELECTRONICS INC., Seoul (KR)

(72) Inventor: Ilsoo Jeon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 126 days.

(21) Appl. No.: 15/080,278

(22) Filed: Mar. 24, 2016

(65) Prior Publication Data

US 2016/0305672 A1 Oct. 20, 2016

(30) Foreign Application Priority Data

Apr. 14, 2015 (KR) ..... 10-2015-0052694

(51) Int. Cl.
*F24F 3/14* (2006.01)
*F25B 39/04* (2006.01)
*F28F 1/32* (2006.01)

(52) U.S. Cl.
CPC ..... *F24F 3/1405* (2013.01); *F25B 39/04* (2013.01); *F28F 1/32* (2013.01); *F24F 2003/144* (2013.01)

(58) Field of Classification Search
CPC ..... F24F 3/1405; F24F 2003/144; F24F 3/14; F28F 1/32; F25B 39/04
See application file for complete search history.

(56) References Cited

U.S. PATENT DOCUMENTS

2007/0240864 A1* 10/2007 Yabu ..... B01D 53/261 165/150
2012/0067555 A1* 3/2012 Sueoka ..... B01D 53/261 165/138
2012/0145364 A1* 6/2012 Oritani ..... F24F 1/0007 165/121
2015/0013371 A1* 1/2015 Cho ..... F24F 3/1405 62/272

FOREIGN PATENT DOCUMENTS

EP 1 748 259 A1 1/2007
EP 2 434 243 A1 3/2012
KR 20-0238251 Y1 10/2001
KR 10-2002-0012774 A 2/2002
KR 10-0859932 B1 9/2008
KR 10-2014-0106493 A 9/2014

* cited by examiner

*Primary Examiner* — Emmanuel Duke
(74) *Attorney, Agent, or Firm* — Dentons US LLP

(57) ABSTRACT

Provided is a dehumidifier. The dehumidifier includes a compressor which circulates a refrigerant, a condenser which condenses the refrigerant, and an evaporator which faces the condenser. Herein, a tube which is disposed in a plurality of rows with respect to the condenser is coupled to a plurality of fins of which a part or all are separated, and a part of a plurality of rows of tubes is not fixed, and thus an air path is ensured relatively largely, and air can smoothly flow, and condensing performance is enhanced, and a temperature of an end of the condenser can be lowered, and cycle efficiency is enhanced.

11 Claims, 11 Drawing Sheets

DEHUMIDIFIER

CROSS-REFERENCE TO RELATED APPLICATION(S)

This application claims priority under 35 U.S.C. § 119 and 35 U.S.C. § 365 to Korean Patent Application No. 10-2015-0052694, filed in Korea on Apr. 14, 2015, which is hereby incorporated by reference.

BACKGROUND

1. Field

The present disclosure relates to a dehumidifier.

2. Background

A dehumidifier is a home appliance which suctions in air, removes moisture contained in the air, and then discharges the dehumidified air.

A refrigeration cycle is driven in the dehumidifier. The refrigeration cycle may include a compressor to compress a refrigerant, a condenser to condense the compressed refrigerant, an expander to expand the condensed refrigerant, and an evaporator to evaporate the expanded refrigerant.

The dehumidifier then suctions and passes the air through a heat exchanger that includes the condenser and the evaporator. The air then exchanges heat with the refrigerant flowing through the heat exchanger, which removes the moisture in the air.

The evaporator absorbs the ambient heat and evaporates a liquid refrigerant. Therefore, a temperature of the air that passes through the evaporator is lowered through the heat exchange with the refrigerant. As the temperature of the air passing through the evaporator is lowered, the moisture contained in the air is condensed, and a dew forms on a surface of the evaporator. The air which has humidity and temperature lowered while passing through the evaporator is also heated while passing through the condenser.

The condenser generally includes a tube through which the refrigerant flows, and a fin to which the tube is coupled. A plurality of rows of tubes may be coupled to the fin. Conventionally, heat conduction through the fin occurs in the plurality of rows of tubes. As a result, a heat exchange rate between the refrigerant flowing through the tubes and the air is reduced, refrigerant condensing efficiency is also reduced, and thus the dehumidification performance is reduced.

SUMMARY

The present disclosure is directed to a dehumidifier having an improved dehumidification performance.

According to an aspect of the present disclosure, a dehumidifier includes a case having an inlet port and a discharge port, a compressor to compress a refrigerant, a condenser to condense the compressed refrigerant, an expander to expand the condensed refrigerant, an evaporator to evaporate the expanded refrigerant, and a fan to provide an airflow from the inlet port to the discharge port, wherein the condenser includes a tube through which the refrigerant flows, the tube formed having a plurality of rows of tubes, and a fin to exchange heat, the fin being attached to the tube, the fin Including a first row fin attached to a first row of tubes among the plurality of rows of tubes, and a second row fin attached to a second row of tubes among the plurality of rows of tubes, whereby at least a portion of the first row fin is separate from the second row fin.

According to another aspect of the present disclosure, a condenser for a dehumidifier Includes a tube through which a refrigerant flows, the tube formed having a first, second, and third row of tubes, a fin to exchange heat, the fin being attached to the tube, wherein the fin includes a first row fin attached to the first row of tubes, a second row fin attached to the second row of tubes, the second row fin being separate from at least a portion of the first row fin, a third row fin attached to the third row of tubes, the third row fin having at least a portion thereof being separate from the second row fin.

The condenser may further include a condenser fixing part to support the tube, wherein the condenser fixing part may include a first fixing part to support a first side of the tube and a second fixing part to support a second side of the tube.

The first fixing part may support the first sides of the first, second, and third row tubes, and the second fixing part may support the second side of the first row tubes and is spaced apart from the second and third row tubes.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Advantages, features, and methods for achieving those of embodiments may become apparent upon referring to embodiments described later in detail together with the attached drawings. However, embodiments are not limited to the embodiments disclosed hereinafter, but may be embodied in different modes. The same reference numbers may refer to the same elements throughout the specification.

Figure 1:
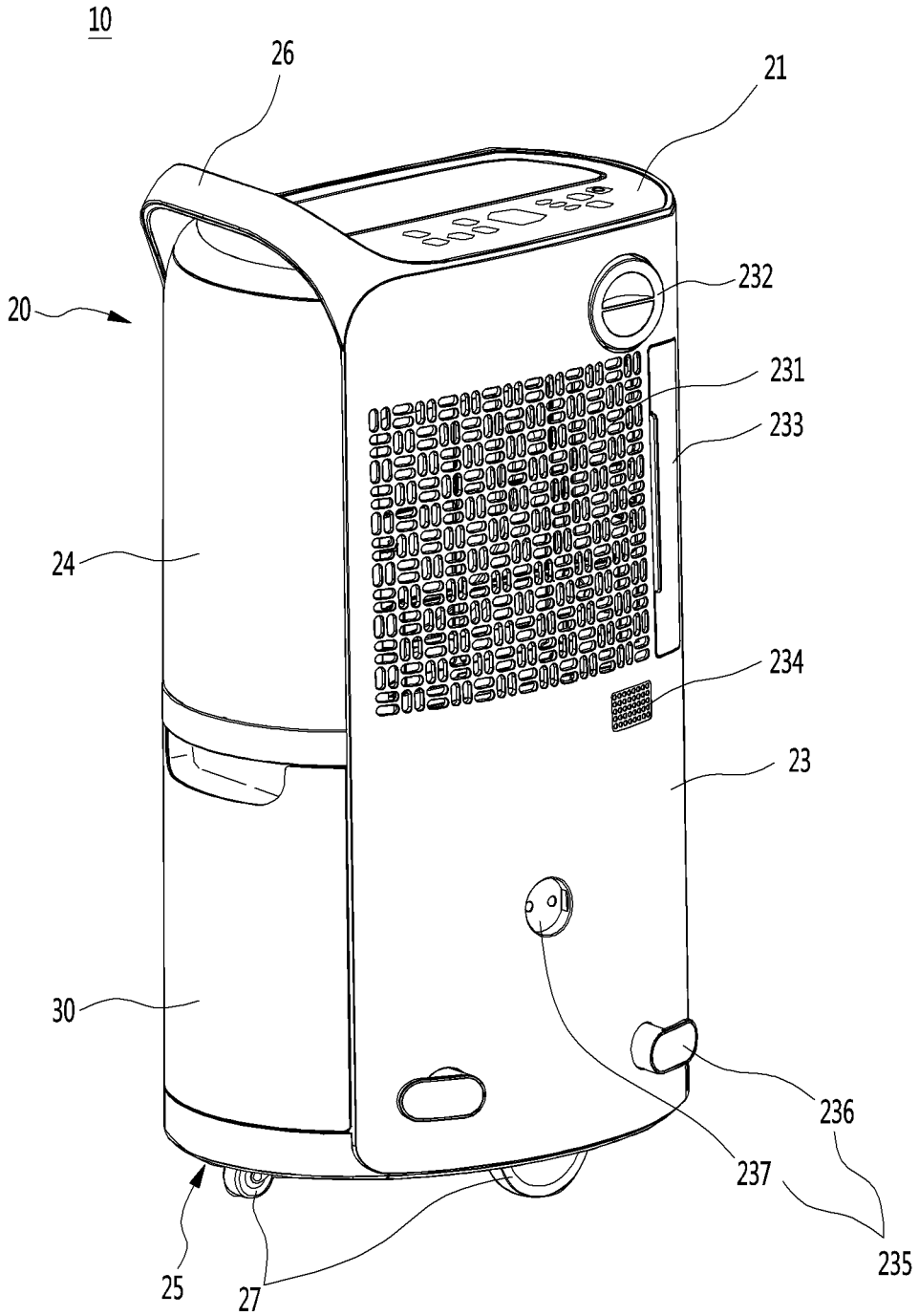
FIG. 1 is a front perspective view of an external form of a dehumidifier according to a first embodiment of the present disclosure.
Figure 2:
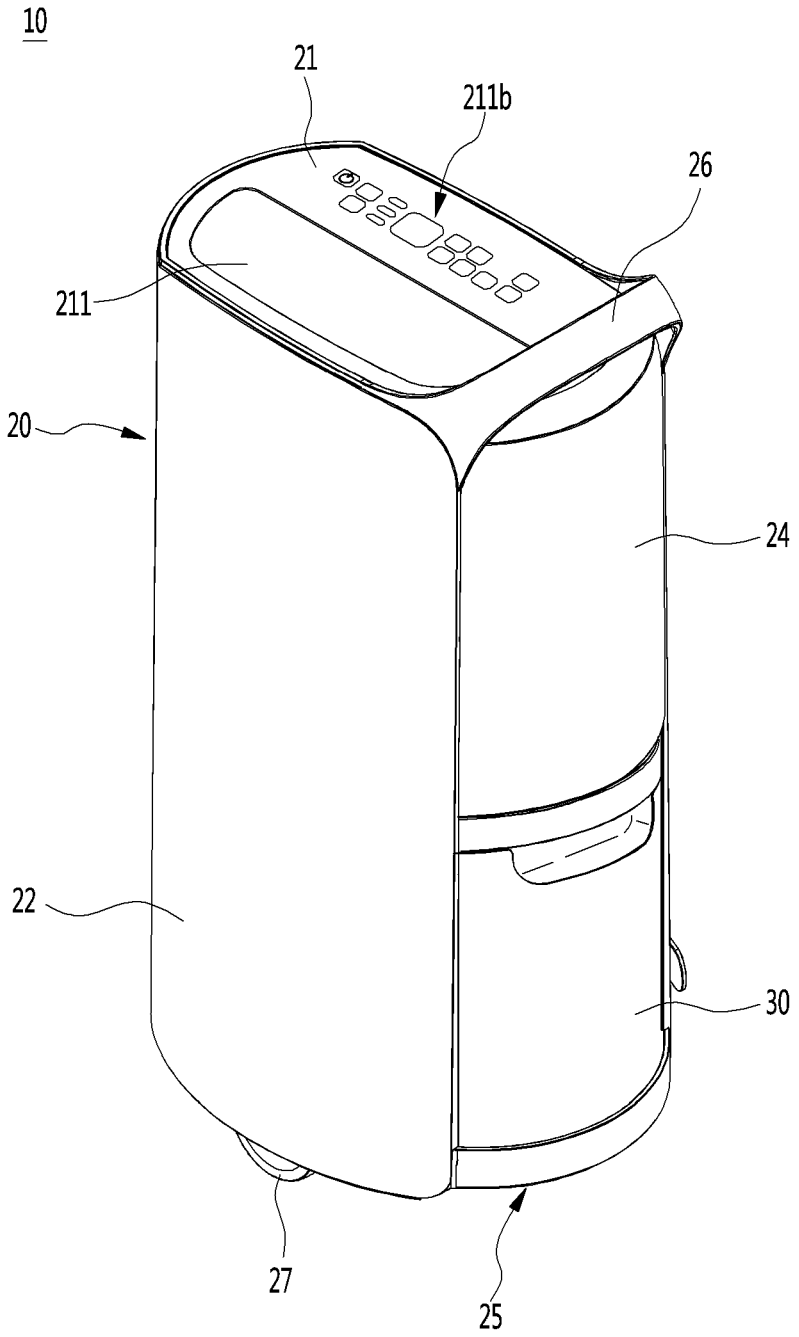
FIG. 2 is a rear perspective view of the form of the dehumidifier according to the first embodiment of the present disclosure.
Figure 3:
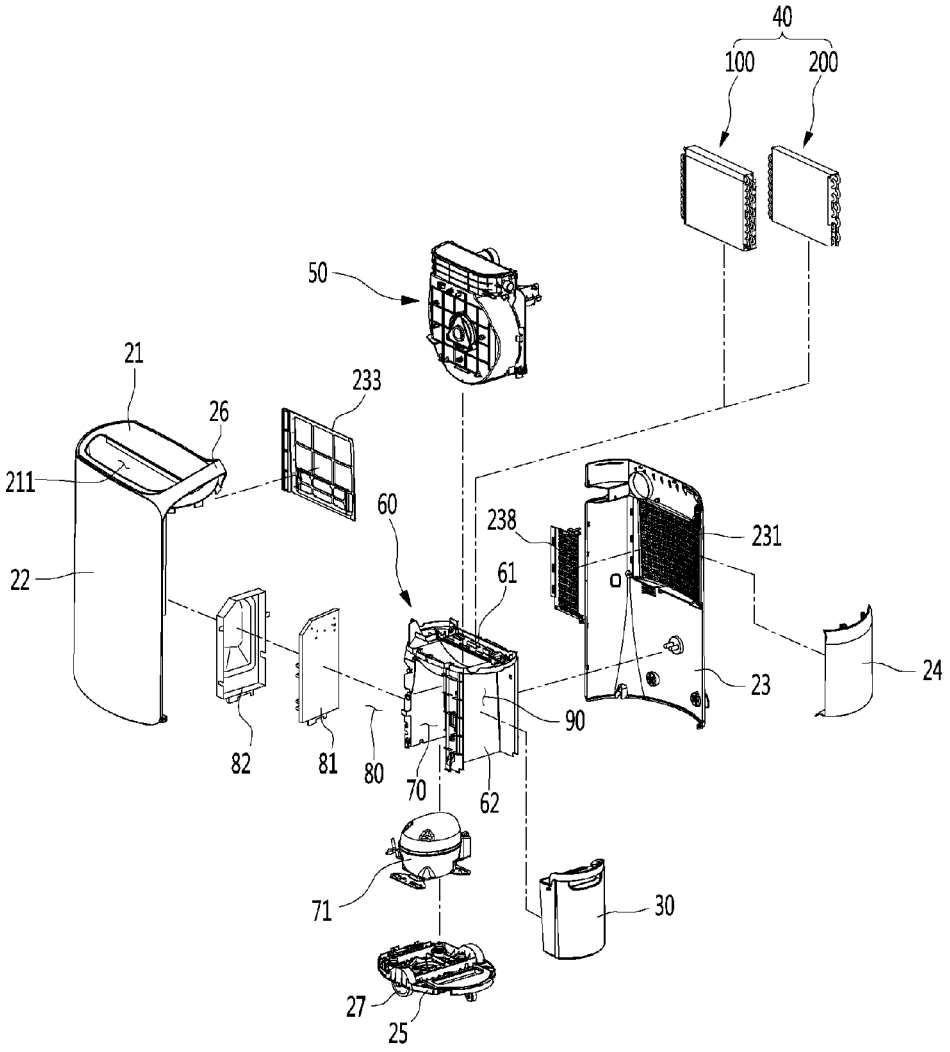
FIG. 3 is an exploded perspective view of an internal structure of the dehumidifier according to the first embodiment of the present disclosure.

FIG. 1 is a front perspective view of an external form of a dehumidifier according to a first embodiment of the present disclosure. FIG. 2 is a rear perspective view of the external form of the dehumidifier according to the first embodiment of the present disclosure. FIG. 3 is an exploded perspective view of an internal structure of the dehumidifier according to the first embodiment of the present disclosure.

Referring to FIGS. 1 to 3, a dehumidifier 10 has an external appearance which is formed by a main body 20 (e.g., a "case"). The main body 20 includes an upper panel 21 which forms an external appearance of an upper surface. A discharge port 211 through which air in the main body 20 is discharged may be formed at the main body 20.

The main body 20 may further include a front panel 23 which forms an external appearance of a front surface. An inlet port 231 through which air outside the main body 20 enters may be formed at the front panel 23.

The main body 20 may further include a rear panel 22 which forms an external appearance of a surface opposite to the front panel 23. The main body 20 may further include a side panel 24 which forms a part of an external appearance of a left side surface. The main body 20 may further include a base 25 which forms an external appearance of a lower surface.

An upper handle 26 by which the main body 20 may be gripped may be formed to protrude at an upper portion of the main body 20, and wheels 27 for movement may be provided at the base 25.

One end of the upper handle 26 may be formed at an edge portion at which an upper end of the front panel 23 meets a front end of the upper panel 21, and the other end of the upper handle 26 may be formed at an edge portion at which an upper end of the rear panel 22 meets a rear end of the upper panel 21.

A louver may be installed at the discharge port 211. The louver may open and close the discharge port 211 and may also control a discharging direction of the air discharged from the main body 20 to an external space. A control panel 211*b* may be provided at a certain position of the upper panel 21 which is spaced apart from the discharge port 211.

In the main body 20, a second discharge port 232 may be further formed at an upper portion of the front panel 23. A discharging accessory may be coupled to the second discharge port 232, so that the dehumidified air is discharged through the discharging accessory. A cap may be installed at the second discharge port 232 and may selectively open and close the second discharge port 232.

More specifically, when the discharging accessory is coupled to the second discharge port 232, the dehumidified air discharged through the second discharge port 232 may be guided by the discharging accessory and may be discharged to a space needing dehumidification. It is understood that the invention is not limited to the shapes and positions of the inlet and discharge ports 231 211 illustrated in the drawings.

The inlet port 231 may be formed in a grille-like shape to prevent foreign objects from entering an internal space of the main body 20. An air filter 233 which filters foreign objects contained in the air passing through the inlet port 231 may be provided at the inlet port 231.

The air filter 233 may be formed in a mesh-like shape to filter the foreign objects contained in the air passing through the inlet port 231, and thus only clean air from which the foreign substances are removed may enter the internal space of the main body 20. The air filter 233 may be inserted into and installed in the main body, and a user may withdraw the air filter 233, wash and dry the air filter 233, and then reuse the air filter 233.

A filter guide 238 which guides inserting and withdrawing of the air filter 233 may be formed at the front panel 23. The air filter 233 may be inserted into or withdrawn from the internal space of the main body 20 through a gap between the filter guide 239 and the inlet port 231.

Since the filter guide 238 is formed to extend laterally, the foreign objects are prevented by the filter guide 238 from entering the internal space of the main body even when the foreign objects enters a space in which the air filter 233 is inserted.

A humidity sensor 234 which senses humidity of a space at which the dehumidifier 10 is installed may be further installed at the front panel 23. A display unit may display the amount of humidity which is sensed by the humidity sensor 234.

A power cord unit 235 may be formed at the front panel 23. The power cord unit 235 may include a cord fixing part 236 around which a power cord for supplying electric power into the main body 20 is wound and a cord insertion part 237 into which the power cord is temporarily inserted and fixed.

The base 25 which forms the external appearance of the lower surface is installed at lower ends of the front panel 23 and the rear panel 22, and the side panel 24 which forms a part of the external appearance of the side surface may be installed at right ends of the front panel 23 and the rear panel 22.

A water tank 30 which accommodates water condensation generated during a dehumidifying process of the air may be provided at a lower side of the side panel 24. A portion of the external appearance of the side surface of the main body 20 may be formed by the water tank 30.

A heat exchange unit 40 which exchanges heat with the air introduced through the inlet port 231 and a fan assembly 50 which enables the air to flow from the inlet port 231 and the discharge port may be provided inside the main body 20.

The air passing through the heat exchange unit 40 exchanges heat with a refrigerant flowing through the heat exchange unit 40, and a temperature thereof is lowered. As a result, moisture contained in the air is condensed, and thus the air is converted into a dry state.

The fan assembly 50 which provides a flow of the air in the main body 20 may be installed at one side of the heat exchange unit 40. When the fan assembly 50 is operated, external air is suctioned into the main body 20 through the inlet port 231, and the air suctioned in is dehumidified while passing through the heat exchange unit 40. The dehumidified air is discharged to the external space through the discharge port 211.

A frame 60 which supports the heat exchange unit 40 and the fan assembly 50 may be provided at a lower side of the heat exchange unit 40 and a fan assembly 50. The frame 60 may be located at the lower side of the heat exchange unit 40 and the fan assembly 50, and the heat exchange unit 40 and the fan assembly 50 may be supported by an upper surface of the frame 60.

The frame 60 may include an upper frame 61 which supports the heat exchange unit 40 and the fan assembly 50, and a lower frame 62 which separates a lower space of the upper frame 61 into a compressor chamber 70, an electronic component chamber 80, and a water tank chamber 90.

The upper frame 61 may be separated into a portion at which the fan assembly 50 is supported and a portion at which the heat exchange unit 40 is supported. The portion at which the heat exchange unit 40 is supported may function as a drain pan into which the condensate water falling from the heat exchange unit 40 drain collects. For example, an upper surface of the portion at which the heat exchange unit 40 is supported may be sloped with a predetermined tilt to enable the condensate water falling from the heat exchange unit 40 to be gathered at a specific position.

The condensate water gathered by the slope of the upper surface of the upper frame 61 falls down and is guided to an upper surface of the water tank 30. The condensate water falling to the water tank 30 is stored in the water tank 30.

A lower half portion of the internal space of the main body 20 may be separated by the lower frame 62 into the electronic component chamber 80, the compressor chamber 70, and the water tank chamber 90. The electronic component chamber 80, the compressor chamber 70 and the water tank chamber 90 may be arranged in a row, but are not limited to such arrangement.

An upper portion of the lower frame 62 may be supported by the upper frame 61, and a lower end thereof may be supported by the base 25.

The lower frame 62 may be installed to cross a space formed by the front panel 23 and the rear panel 22 in forward and backward directions and thus separate the lower half portion of the internal space of the main body 20 into three sections in left and right directions of the main body 20.

The upper frame 61 and the lower frame 62 may be formed in an approximately "n" shape when seen from a front side, but is not limited to such shape. The upper and lower frames 61 and 62 may also be formed so that the heat exchange unit 40 and the fan assembly 50 are located at an upper side thereof and the electronic component chamber 80, and the compressor chamber 70 and the water tank chamber 90 are located at a lower side thereof. Accordingly, the electronic component chamber 80 and the water tank chamber 90 may be located at left and right sides based on the compressor chamber 70.

Meanwhile, a compressor 71 which compresses the refrigerant flowing inside the heat exchange unit 40 may be provided at the compressor chamber 70. A plurality of electronic components may be provided at the electronic component chamber 80.

For example, a main board 81 for controlling the plurality of electronic components may be provided at the electronic component chamber 80. The main board 81 may be covered by a control case 82 which protects the main board 81 from an external shock. The main board 81 may be provided in the control case 82, and an opposite side to the control case 82 may be covered by a control cover (not shown) to protect the main board 81 from the external shock.

Figure 4:
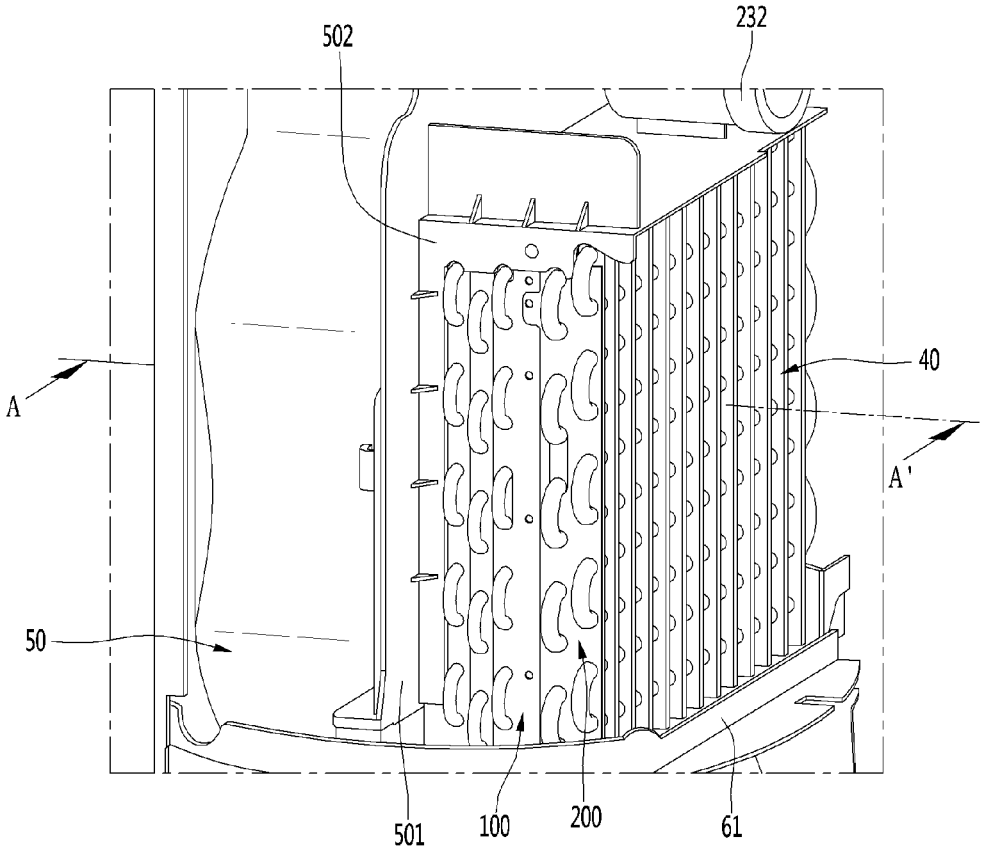
FIG. 4 is a state diagram illustrating a state in which a heat exchanger of the dehumidifier according to the first embodiment of the present disclosure is coupled to a fan assembly when seen from a left side.
Figure 5:
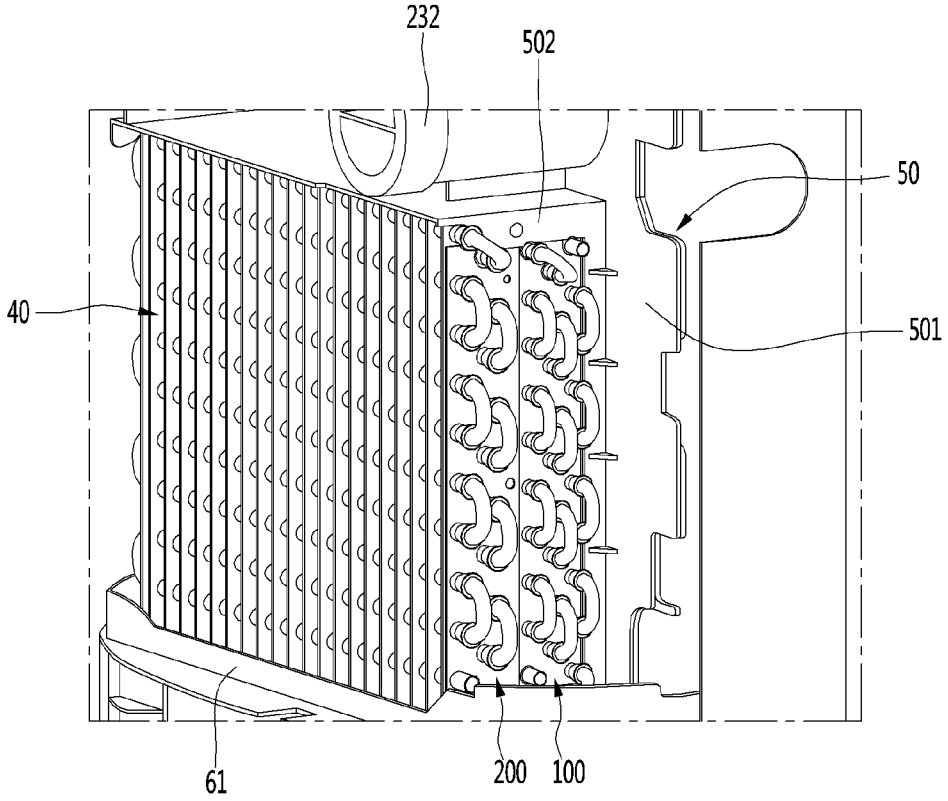
FIG. 5 is a state diagram illustrating the state in which the heat exchanger of the dehumidifier according to the first embodiment of the present disclosure is coupled to the fan assembly when seen from a right side.
Figure 6:
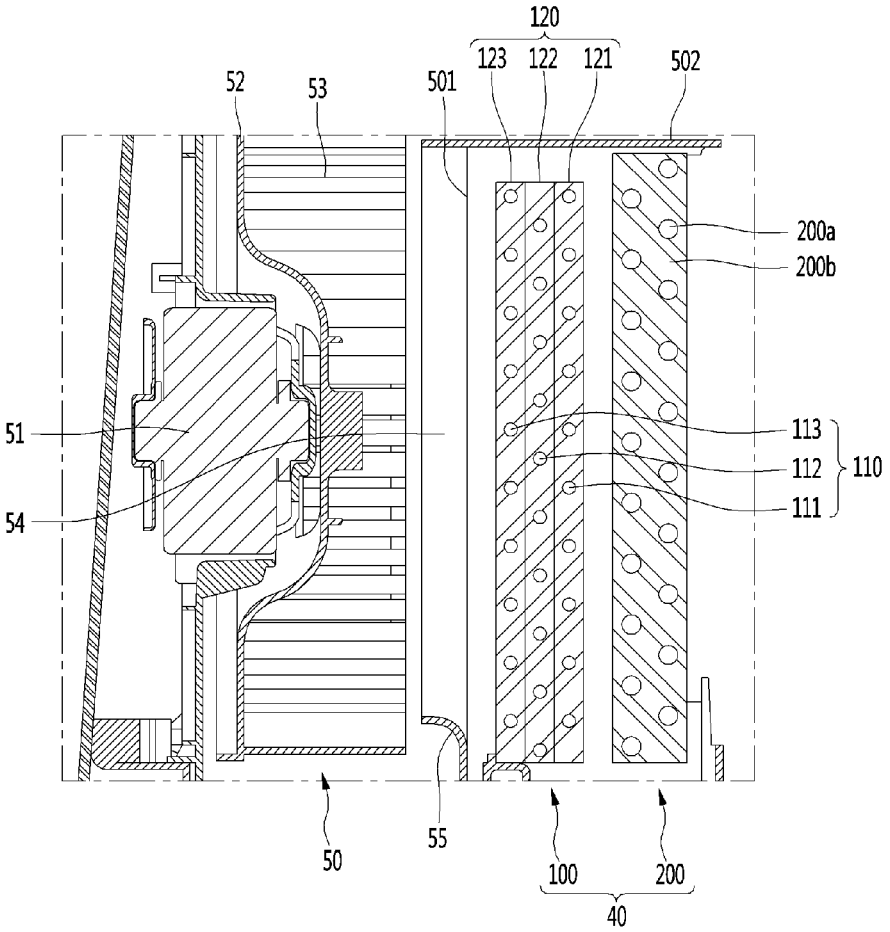
FIG. 6 is a cross-sectional view taken along a line A-A' of FIG. 4.

FIG. 4 is a diagram illustrating a state in which a heat exchanger of the dehumidifier according to the first embodiment of the present disclosure is coupled to the fan assembly when viewed from a left side. FIG. 5 is a diagram illustrating the state in which the heat exchanger of the dehumidifier according to the first embodiment of the present disclosure is coupled to the fan assembly when viewed from a right side. FIG. 6 is a cross-sectional view taken along a line A-A' of FIG. 4.

Referring to FIGS. 4 to 6, the heat exchange unit 40 and the fan assembly 50 are supported at an upper side of the upper frame 61. The heat exchange unit 40 may be provided at a front of the fan assembly 50 and may be located inside the inlet port 231.

The fan assembly 50 may include a fan motor 51 which generates a driving force, a hub 52 which is coupled to the fan motor 51, a plurality of blades 53 which are provided at an outer circumferential surface of the hub 52 to be spaced apart from each other, a fan inlet part 54 which introduces the air into the fan assembly 50, and a guide unit 55 which is located at a front end of the blades 53 to guide introduction of the air. The fan inlet part 54 forms a front end of the guide unit 55.

The dehumidifier 10 may further include a blocking wall 501 which is installed at a front outer circumferential surface of the fan assembly 50. The blocking wall 501 may block the air passed through the heat exchange unit 40 from flowing to an outside of the fan assembly 50.

The blocking wall 501 may be surround an outside of a boundary between the heat exchange unit 40 and the guide unit 55. Therefore, the air passed through the heat exchange unit 40 may be guided to the fan inlet part 54 by the blocking wall 501.

The dehumidifier 10 may include a supporting part 502 which supports an outside of the heat exchange unit 40. The supporting part 502 may extend along an outer surface of the heat exchange unit 40 from the blocking wall 501. For example, the supporting part 502 may be attached to an upper surface and a side surface of the heat exchange unit 40 and may support the heat exchange unit 40.

A front surface of the supporting part 502 may be in contact with a rear surface of the front panel 23. The second discharge port 232 may be formed at an upper portion of the supporting part 502. The supporting part 502 and the second discharge port 232 may be integrally formed.

The heat exchange unit 40 may include a condenser 100 which condenses the refrigerant compressed by the compressor 71 and an evaporator 200 which is installed close to the condenser 100 in a direction of the inlet port 231 and evaporates the refrigerant expanded in the expander.

The condenser 100 may be provided at a front side of the fan assembly 50 corresponding to a position of the fan assembly 50. That is, the fan inlet part 54 of the fan assembly 50 may be located at a side of an outlet port of the condenser based on an air flowing direction.

The condenser 100 may form a plurality of rows and include a tube 110 through which the refrigerant flows and a fin 120 to which the tube 110 is coupled. The tube 110 may have a plurality of rows. For example, the tube 110 may be arranged having three rows. The tube 110 in each row may be arranged to be vertically spaced apart from each other.

Specifically, the tube 110 may include a plurality of first row tubes 111 which are arranged to form a first row, a plurality of second row tubes 112 which are provided at one side of the plurality of first row tubes and form a second row, and a plurality of third row tubes 113 which are provided at one side of the plurality of second row tubes and form a third row.

It is understood that, among the first to third row tubes 111, 112 and 113, the first row tubes 111 is the closest distance to the evaporator 200. Also, it is understood that, among the first to third row tubes 111, 112 and 113, the third row tubes 113 is the closest distance to the fan assembly 50. The second row tubes 112 are located between the first row tubes 111 and the third row tubes 113.

The air introduced through the inlet port 231 of the front panel 23 passes through the evaporator 200 and then passes through the condenser 100 in the order of the first row tubes 111, the second row tubes 112, and the third row tubes 113, and then moves to the fan assembly 50.

Each of the plurality of rows of tube 110 may be formed to have the same shape and size or may be formed to have a different shape and size. For example, each of the plurality of rows of tube 110 may have a circular pipe-like shape but is not limited thereto.

Figure 8:
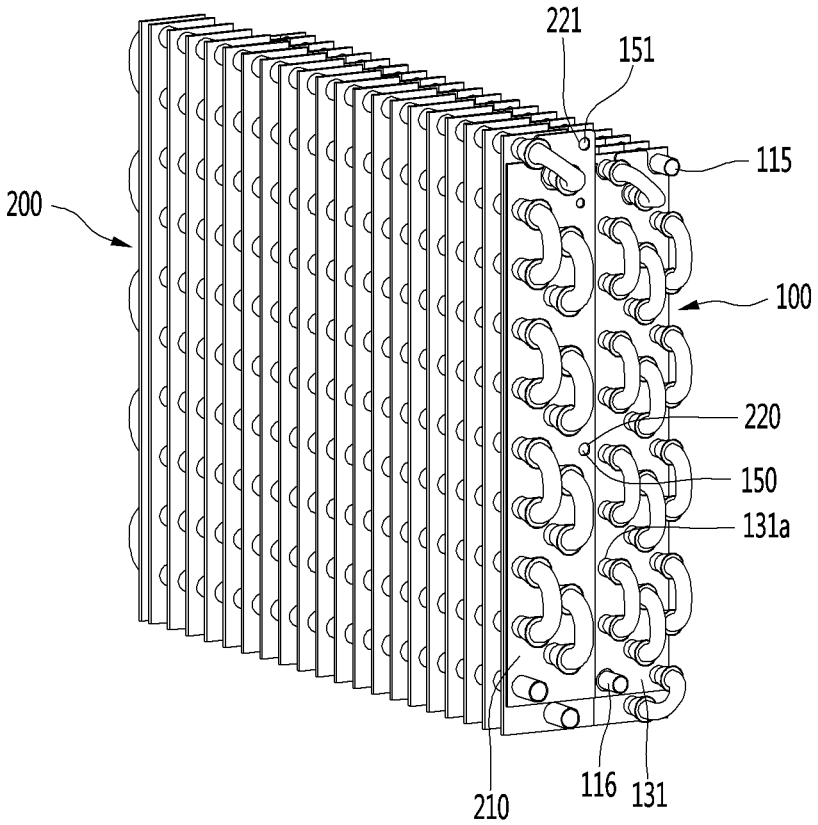
FIG. 8 is a state diagram illustrating the shape of the condenser and the evaporator of the dehumidifier according to the first embodiment of the present disclosure when seen from a right side.

Referring to FIG. 8, a refrigerant inlet port 115 is formed at the third row tubes 113 of the condenser 100, and a refrigerant discharge port 116 is formed at the first row tubes 113. For example, the refrigerant introduction port 115 may be connected to a tube located at an uppermost side among the third row tubes 113. The refrigerant discharge port 116 may be connected to a tube located at a lowermost side among the first row tubes 111.

Therefore, the refrigerant is introduced into the condenser 100 through the refrigerant introduction port 115, passes, in turn, through the third row tubes 113, the second row tubes 112, and the first row tubes 111, and is discharged through the refrigerant discharge port 116.

The refrigerant in the first row tubes 111 forms a gas or two-phase refrigerant section, the refrigerant in the second row tubes 112 forms a two-phase or liquid refrigerant section, and the refrigerant in the third row tubes 113 forms a liquid or supercooled refrigerant section.

The fin 120 may be formed having a thin plate shape and a tube through-hole in which the tube 110 is accommodated. The fin 120 may extend vertically and may be arranged to be spaced apart in left and right directions.

The fins 120 may form a plurality of rows corresponding to the plurality of rows of tube 110. Each of the fins 120 forming each row may be separated from each other. For example, the plurality of rows includes three rows, but is not limited thereto.

Specifically, the fins 120 having the three rows includes a first row fin 121 in which the first row tubes 111 are inserted, a second row fin 122 in which the second row tubes 112 are inserted, and a third row fin 123 in which the third row tubes 113 are inserted. The first to third row fins include a plurality of fins which are horizontally stacked.

Among the first to third row fins 121, 122 and 123, the first row fin 121 may be located closest to the evaporator 200, and the second row fin 122 and the third row fin 123 may be located gradually closer to the fan assembly 50 (e.g., third row fin 123 may be located closer to the fan assembly 50 than the second row fin 122).

The first to third row fins 121, 122 and 123 may be formed separately from each other.

The fins forming the plurality of rows may be completely separated from each other such that the heat of tubes forming one row is restricted from being transferred to other tubes forming another row. As such, heat transfer between the refrigerants may be minimized, and heat exchange efficiency may be enhanced.

The evaporator 200 may be provided at a front side of the condenser 100 to be spaced apart from the condenser 100 and to face the condenser 100. For example, according to an embodiment of the disclosure, a distance between the evaporator 200 and the condenser 100 may be about 10 mm. It is understood that the distance is not limited thereto.

The evaporator 200 may include a tube 200*a* which forms a plurality of rows and through which the refrigerant flows, and a fin 200*b* at which the tube 200*a* is coupled. For example, according to an embodiment of the disclosure, the plurality row includes two rows. It is understood that the plurality of rows is not limited to two rows.

The condenser 100 and the evaporator 200 which are spaced apart from each other may be fixed to predetermined positions by the supporting part 502. The air passing through the evaporator 200 exchanges heat with the refrigerant flowing inside the evaporator 200, which lowers a temperature thereof. As the temperature of air passing through the evaporator 200 is lowered, the moisture contained in the air is condensed and forms a dew on a surface of the evaporator 200.

The air having the lowered humidity and temperature while passing through the evaporator 200 may pass through a drying process while passing through the condenser 100. As a result, the moisture contained in the air is condensed, and thus the air is changed into the dry state.

Figure 7:
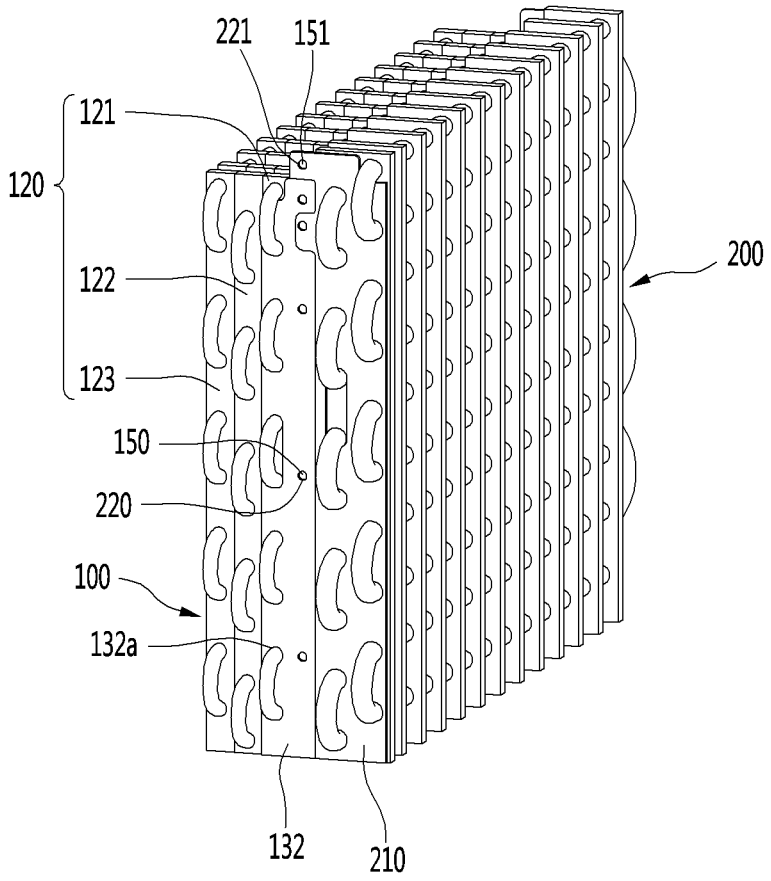
FIG. 7 is a state diagram illustrating shapes of a condenser and an evaporator of the dehumidifier according to the first embodiment of the present disclosure when seen from a left side.

FIG. 7 is a state diagram illustrating shapes of the condenser and the evaporator of the dehumidifier according to the first embodiment of the present disclosure when seen from a left side. FIG. 8 is a state diagram illustrating the shape of the condenser and the evaporator of the dehumidifier according to the first embodiment of the present disclosure when seen from a right side.

Referring to FIGS. 7 and 8, the dehumidifier 10 includes an evaporator fixing part 210. The evaporator fixing part 210 may be formed to fix the tube 200*a* included in the evaporator 200. The evaporator fixing part 210 may be provided at both sides of the tube 200*a*. The tube 200*a* may be coupled to one evaporator fixing part 210 and may extend to the other evaporator fixing part 210, and then may extend again to the one evaporator fixing part 210 after a direction change.

The condenser 100 may include a condenser fixing part 130 which fixes the tube 110 included in the condenser 100. The condenser fixing part 130 may include a first fixing part 131 which is coupled to one side of the tube 110 and a second fixing part 132 which is coupled to the other side. The tube 110 may extend in a horizontal direction from the first fixing part 131 toward the second fixing part 132.

The first fixing part 131 may include a first through-hole 131*a* through which the tube forming the plurality of rows passes. That is, the first through-hole 131*a* may be formed so that the tube forming the three rows is inserted therein.

The second fixing part 132 may include a second through-hole 132*a* through which the first row tubes 111 are fixed. That is, only the first row tubes 111 are fixed to the second fixing part 132. However, because the first row tubes 111 are connected to the second and third row tubes 112 and 113, a support for the second and third row tubes 112 and 113 may be maintained even through only the first row tubes 111 are supported by the second fixing part 132. Thus, the second and third row tubes 112 and 113 may not be fixed to the second fixing part 132.

The first row tubes 111 may be fixed to the first fixing part 131 and extend to the second fixing part 132 and then extend again to the first fixing part 131 after a direction change. For example, the part of the tube at which the direction is changed may be referred to as a bending tube.

In the same manner, the second and third row tubes 112 and 113 may also include the bending tubes. However, because the second and third row tubes 112 and 113 are not supported by the second fixing part 132, the second and third row tubes 112 and 113 extend from the first fixing part 131 toward one side and then extend again to the first fixing part 131 after the direction change.

At this point, a width of the first fixing part 131 is wider than a width of the second fixing part 132. For example, according to an embodiment, the width of the first fixing part 131 may be three times larger than that of the second fixing part 132. It is understood that the width of the first fixing part 131 is not limited to being three times larger than that of the second fixing part 132.

By the above-described structure, one side portion of each of the first to third row tubes 111, 112 and 113 is each fixed to the first fixing part 131, and the other side portion of each of the first to third row tubes 111, 112 and 113 has a degree of freedom which is relatively movable with respect to each other. Therefore, when the condenser 100 is installed inside the case, a degree of installation freedom is provided, a distance between the fins 120 is ensured, and thus the heat transfer between the fins 120 may be prevented.

Since an air path between the fins 120 forming the adjacent rows may be ensured to be relatively wide, the air path is not obstructed by the fans 120 even when the fins 120 are arranged to be inclined with respect to an airflow direction.

The evaporator fixing part 210 and the condenser fixing part 130 may be coupled by a first fastening member 150.

That is, one evaporator fixing part 210 and the first fixing part 131 may be coupled by one first fastening member 150, and another evaporator fixing part 210 and the second fixing part 132 may be coupled by another first fastening member 150.

To this end, a first fastening hole 220 at which the one first fastening member 150 is coupled is formed at the one evaporator fixing part 210. The first fastening hole 220 is also formed at the other evaporator fixing part 210.

A plurality of first fastening holes 220 may be provided and arranged vertically, and a plurality of one first fastening member 150 may be provided corresponding to the plurality of first fastening holes 220.

By such a fastening structure, the evaporator 200 may be arranged spaced apart from the condenser 100 at a preset distance.

A second fastening hole 221 for coupling with the supporting part 502 may be formed at the evaporator fixing part 210. The second fastening hole 221 may be formed at an upper portion of the evaporator fixing part 210. The evaporator fixing part 210 and the supporting part 502 may be coupled by a second fastening member 151.

Figure 9:
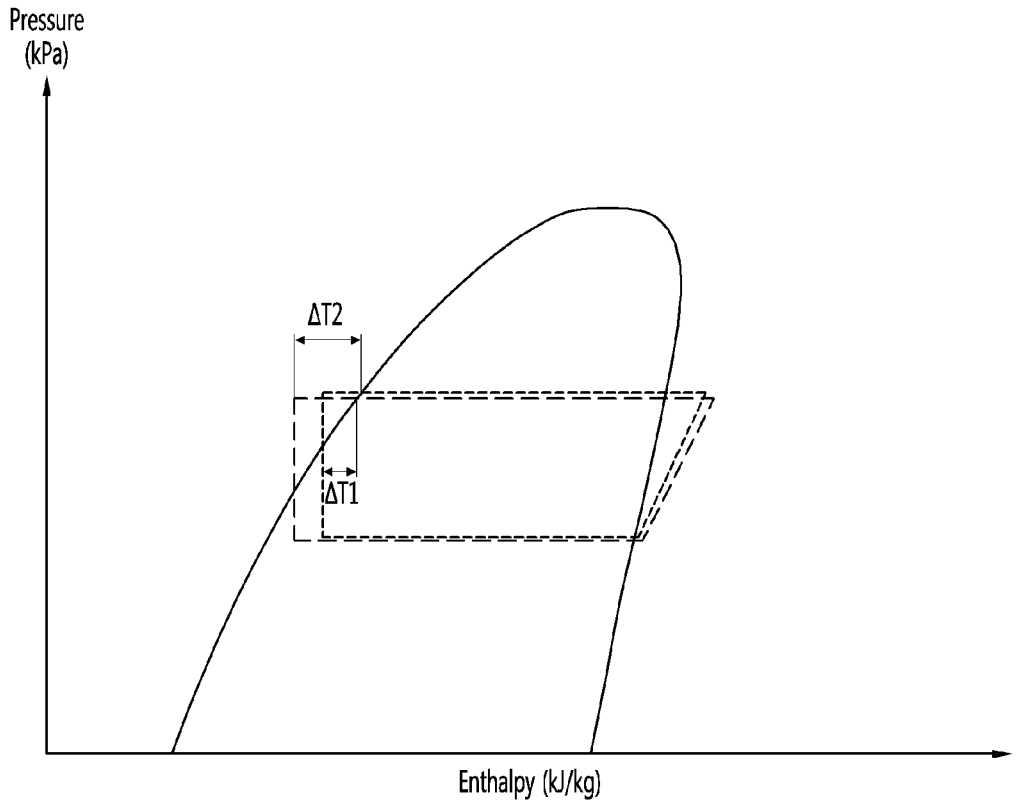
FIG. 9 is a P-H diagram of the dehumidifier according to the first embodiment of the present disclosure.

FIG. 9 is a P-H diagram of the dehumidifier according to the first embodiment of the present disclosure. Table 1 below shows comparative data of a condensing capacity, condensing efficiency and a temperature of a refrigerant outlet end in a case in which an integrated fin according to the related art is provided and a case in which a three-row fin according to the present disclosure is provided. Herein, the integrated fin is a structure in which a fin having one row is coupled to a tube having three rows.

TABLE 1

| | Integrated Fin | Three-Row Fin | Effect |
|---|---|---|---|
| Capacity [kcal/h] | 14.85 | 16.32 | Increased by 10% |
| Heat exchange efficiency [L/HrKw] | 1.95 | 2.24 | Increased by 15% |
| Temperature of refrigerant outlet end [° C.] | 30.5 | 20.6 | Lowered by 9.9° C. |

Specifically, a heat exchange capacity in the related art is 14.85 [kcal/h], and a capacity in the three-row fin embodiment is 16.32 [kcal/h], and thus it may be understood that the capacity is increased by 10%. For the heat exchange efficiency, the related art is 1.95 [L/HrKw], and the three-row fin embodiment is 2.24 [L/HrKw], and thus it is increased by 15%. Also, for the temperature of the refrigerant outlet end, the related art is 30.5 [° C.], and the three-row fin embodiment is 20.6 [° C.], and it is reduced by 9.9 [° C.], and thus a supercooling degree may be further ensured. Therefore, it may be understood that performance of the condenser 100 is enhanced.

In FIG. 9, a thin dotted line is a P-H diagram according to the related art, and a thick dotted line is a P-H diagram according to the three-row fin embodiment. The supercooling degree $\Delta T2$ of present disclosure is greater than the $\Delta T1$ of the related art by 9.9 [° C.], and thus it may be understood that the performance is enhanced.

Figure 10:
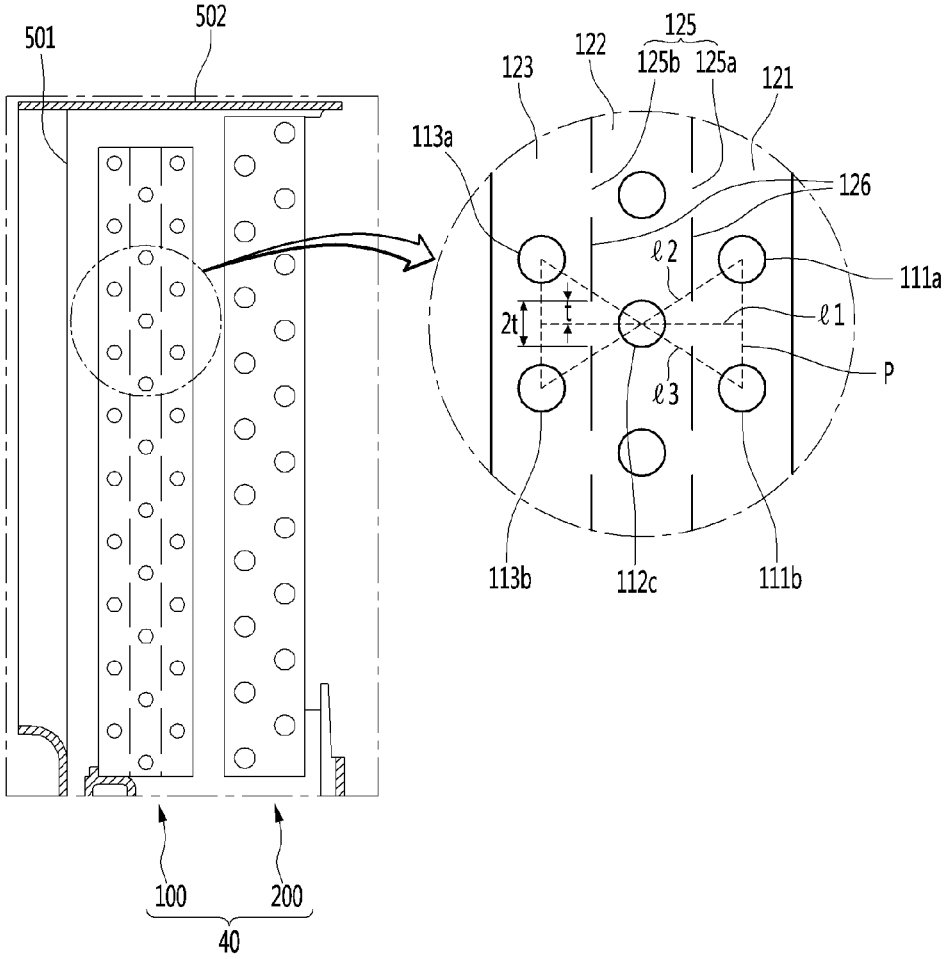
FIG. 10 is a cross-sectional view of a condenser of a dehumidifier according to a second embodiment of the present disclosure.

FIG. 10 is a cross-sectional view of a condenser of a dehumidifier according to a second embodiment of the present disclosure. Referring to FIG. 10, a fin 120 according to a second embodiment of the present disclosure may include a connection part 125 which couples two adjacent fins 120 and a cut-away part 126 which is formed between two adjacent connection parts 125.

The connection part 125 may include a first connection part 125*a* formed between the first row fin 121 and the second row fin 122, and a second connection part 125*b* formed between the second row fin 122 and the third row fin 123.

It is understood that, based on the embodiment shown in FIG. 10, the first row fin 121 forms a row located at the rightmost side and the third row fin 123 forms a row located at the leftmost side. It is also understood that the second row fin 122 is located between the first and third row fins 121 and 123.

More specifically, as shown, at least a portion of the first row fin 121 and at least a portion of the second row fin 122 are coupled by the first connection part 125*a* and may be spaced apart from each other by one cut-away part 126. At least a portion of the second row fin 122 and at least a portion of the third row fin 123 are coupled by the second connection part 125*b* and may be spaced apart from each other by the other cut-away part 126.

At this point, the one cut-away part 126 located at a rear of the first row fin 121 may restrict the heat transfer from the second row fin 122 to the first row fin 121, and the other cut-away part 126 located at a rear of the second row fin 122 may restrict the heat transfer from the third row fin 123 to the second row fin 122.

The first connection part 125*a* and the second connection part 125*b* are formed at heights corresponding to each other based on a vertical length of the fin.

A plurality of cut-away parts 126 may be provided spaced apart from each other. For example, the plurality of cut-away parts 126 may be located between the plurality of fins 120 and may be arranged in a row to be spaced apart from each other.

The plurality of first, second, and third row tubes 111, 112 and 113 are arranged in parallel, and the plurality of cut-away parts 126 may be arranged in parallel with the plurality of first, second, and third row tubes 111, 112 and 113.

However, an arrangement of the plurality of cut-away parts 126 is not limited thereto. Other arrangements having a configuration for restricting the heat exchange through the fins 120 and separating the fins 120 from each other are allowed.

For convenience of explanation, one of the second row tubes 112 is referred to as a second row reference tube 112*c*, two of the first row tubes 111 located closest to the second row reference tube 112*c* are referred to as a first row upper tube 111*a* and a first row lower tube 111*b*, and two of the third row tubes 113 located closest to the second row reference tube 112*c* are referred to as a third row upper tube 113*a* and a third row lower tube 113*b*.

Here, the first row upper tube 111*a* and the third row upper tube 113*a* may be located at upper sides relative to the first row lower tube 111*b* and the third row lower tube 113*b*, respectively.

The connection part 125 meets a first imaginary extension line l1 which extends horizontally from a center of the second row reference tube 112*c*. That is, the first connection part 125*a* is formed along the first extension line l1 between one corner of the first row fin 121 and one corner of the second row fin 122, and the second connection part 125*b* is formed along the first extension line l1 between the other corner of the second row fin 122 and one corner of the third row fin 123.

The connection part 125 has a preset vertical length t based on the first extension line l1 and thus has a total length of 2t. A length of t may be smaller than a radius r of one lube.

The cut-away part 126 may be formed to have a certain shape between two adjacent connection parts 125. For example, the cut-away part 126 may intersect with a second imaginary extension line l2 which extends from a center of the first row upper tube 111*a* toward a center of the third row lower tube 113*b* and also intersect with a third imaginary extension line l3 which extends from a center of the first row lower tube 111*b* toward a center of the third upper lower tube 113*a*.

By such a structure, the cut-away part 126 blocks the shortest routes l2 and l3 on the fins 120 through which the heat is transferred and thus reduces the heat transfer due to the fin 120 of the tube. Also, since the connection part 125 which is not cut away is provided, damage and deformation of the fin 120 may be prevented.

Figure 11:
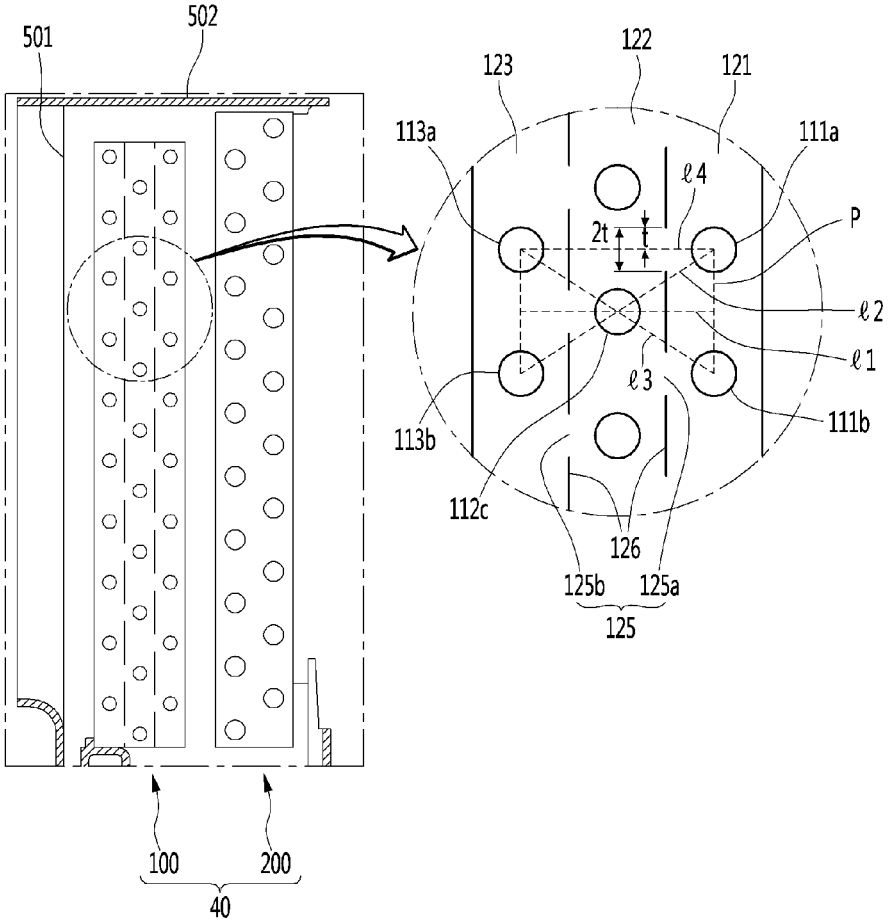
FIG. 11 is a cross-sectional view of a condenser of a dehumidifier according to a third embodiment of the present disclosure.

FIG. 11 is a cross-sectional view of a condenser of a dehumidifier according to a third embodiment of the present disclosure. The embodiment of FIG. 11 is different from the second embodiment regarding the arrangement of the connection part 125 and thus a description thereof will be provided with an emphasis on the difference. The description that is the same as that for the second embodiment are referred to the description and the reference numerals of the second embodiment.

A first connection part 125*a* and a second connection part 125*b* according to a third embodiment are provided at different heights from each other. That is, the first connection part 125*a* and the second connection part 125*b* are disposed in the form of a zigzag in a vertical direction.

One of the first connection part 125*a* and the second connection part 125*b* may be located on a first imaginary extension line l1 which extends horizontally from a center of the second row reference tube 112*c*, and the other one of the first connection part 125*a* and the second connection part 125*b* may be located on a fourth imaginary extension line l4 which extends from a center of the first row upper tube 111*a* toward a center of the third row upper tube 113*a*.

For example, the first connection part 125*a* may be located on the fourth extension line l4, and the second connection part 125*b* may be located on the first extension line l1. That is, the first connection part 125*a* may be located on the fourth extension line l4 which extends backward from one of the first row tubes 111, and the second connection part 125*b* may be located on the first extension line l1 which extends backward from one of the second row tubes 112.

In another example, the first connection part 125*a* may be located on the first extension line l1, and the second connection part 125*b* may be located on the fourth extension line l4. That is, the first connection part 125*a* may be located on the first extension line l1 which extends forward from one of the second row tubes 112, and the second connection part 125*b* may be located on the fourth extension line l4 which extends forward from one of the third row tubes 113.

The cut-away part 126 intersects the second extension line l2 and the third extension line l3 which are the shortest distances between the tubes. The heat transfer through the shortest distances thus may be prevented.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dehumidifier comprising:
- a case having an inlet port and a discharge port;
- a compressor to compress a refrigerant;
- a condenser to condense the compressed refrigerant;
- an expander to expand the condensed refrigerant;
- an evaporator to evaporate the expanded refrigerant; and
- a fan to provide an airflow from the inlet port to the discharge port,
- wherein the condenser comprises:
  - a tube through which the refrigerant flows, the tube formed having a plurality of rows of tubes, and
  - a fin to exchange heat, the fin being attached to the tube, the fin comprising:
    - a first row fin attached to a first row of tubes among the plurality of rows of tubes,
    - a second row fin attached to a second row of tubes among the plurality of rows of tubes,
    - a third row fin attached to a third row of tubes among the plurality of rows of tubes, and
    - a connection part to couple two adjacent rows of fins,
    - wherein a portion of the first row fin is separate from the second row fin,
    - wherein a portion of the third row fin is separate from the second row fin,
    - wherein the connection part comprises a first connection part to connect the first row fin with the second row fin, and a second connection part to connect the second row fin with the third row fin,
    - wherein the condenser further comprises a condenser fixing part to support the tube, wherein the condenser fixing part comprises a first fixing part to support a first side of the tube and a second fixing part to support a second side of the tube, and
    - wherein the first fixing part supports the first sides of the first, second, and third row tubes, and the second fixing part supports the second side of the first row tubes and is spaced apart from the second and third row tubes.

2. The dehumidifier of claim 1, wherein a width of the first fixing part is larger than a width of the second fixing part.

3. The dehumidifier of claim 1, wherein, while a first side of the second and third row tubes are supported at the first fixing part, and the other sides of the second and third row tubes are movable with respect to the first fixing part.

4. The dehumidifier of claim 1, further comprising:
- a blocking wall which is provided at an outer circumferential surface of the fan assembly and blocks the air from flowing to an outside of the fan assembly; and a supporting part to support outside surfaces of the evaporator and the condenser.

5. The dehumidifier of claim 4, wherein the evaporator comprises an evaporator fixing part to support a tube of the evaporator, whereby the evaporator fixing part is coupled with the condenser fixing part by a first fastening member and coupled with the supporting part by a second fastening member.

6. The dehumidifier of claim 1, wherein the first connection part and the second connection part are provided parallel to each other.

7. The dehumidifier of claim 1, wherein the first connection part and the second connection part are provided at heights corresponding to each other.

8. The dehumidifier of claim 1, wherein the first and second connection parts are provided at an extension line which extends forward and backward from one of the second row tubes.

9. The dehumidifier of claim 1, wherein the first and second connection parts are provided at different heights from each other.

10. The dehumidifier of claim 9, wherein the first connection part is provided at a first extension line which extends backward from one of the first row tubes, and the second connection part is provided at a second extension line which extends backward from one of the second row tubes.

11. The dehumidifier of claim 9, wherein the first connection part is provided at a first extension line which extends forward from one of the second row tubes, and the second connection part is provided at a second extension line which extends forward from one of the third row tubes.

* * * * *